US007988010B2

(12) United States Patent
Yang et al.

(10) Patent No.: US 7,988,010 B2
(45) Date of Patent: Aug. 2, 2011

(54) PROTECTIVE CASE FOR PORTABLE ELECTRONIC DEVICES

(75) Inventors: Mu-Wen Yang, Taipei (TW); Chih-Chiang Chang, Taipei (TW)

(73) Assignee: FIH (Hong Kong) Limited, Kowloon (HK)

( * ) Notice: Subject to any disclaimer, the term of this patent is extended or adjusted under 35 U.S.C. 154(b) by 0 days.

(21) Appl. No.: 12/649,556

(22) Filed: Dec. 30, 2009

(65) Prior Publication Data

US 2010/0258463 A1 Oct. 14, 2010

(30) Foreign Application Priority Data

Apr. 13, 2009 (CN) ..... 2009 1 0301515

(51) Int. Cl.
*B65D 55/16* (2006.01)

(52) U.S. Cl. ... 220/375; 220/810; 220/770; 229/125.18; 229/125.38; 229/117.24

(58) Field of Classification Search ..... 206/320, 206/1.5; 220/4.21, 4.22, 375, 754, 847, 810, 220/756, 757, 770, 769, 768; 229/117.22, 229/117.24, 117.25, 125.18, 125.22, 125.38, 125.11, 117.26
See application file for complete search history.

(56) References Cited

U.S. PATENT DOCUMENTS

| | | | | | |
|---|---|---|---|---|---|
| 265,985 | A * | 10/1882 | Seabury | 229/125.01 |
| 335,777 | A * | 2/1886 | Schaffer et al. | 229/117.24 |
| 1,322,290 | A * | 11/1919 | Cibulka | 229/125.22 |
| 2,260,951 | A * | 10/1941 | Mulnix | 229/117.19 |
| 2,387,329 | A * | 10/1945 | Jacobs | 229/117.24 |
| 3,848,766 | A * | 11/1974 | Gantt et al. | 206/139 |
| 5,165,583 | A * | 11/1992 | Kouwenberg | 224/148.3 |
| 5,531,345 | A * | 7/1996 | Nakamura et al. | 220/3.8 |
| 5,975,298 | A * | 11/1999 | Sankey et al. | 206/387.13 |
| 6,766,918 | B1 * | 7/2004 | Bogdanovich | 220/375 |
| 7,763,807 | B2 * | 7/2010 | Richter | 174/138 F |

* cited by examiner

*Primary Examiner* — David T Fidei
(74) *Attorney, Agent, or Firm* — Clifford O. Chi

(57) ABSTRACT

A protective device for portable electronic device includes a first housing, a second housing and a connecting strap. One end of the connecting strap is attached to the first housing and another end of the connecting strap is attached to the second housing. The connecting strap is pulled outwardly to bring the first housing and the second housing together to be connected to each other or pulled inwardly as the first housing and the second housing are separated from each other.

12 Claims, 5 Drawing Sheets

PROTECTIVE CASE FOR PORTABLE ELECTRONIC DEVICES

BACKGROUND

1. Technical Field

The present disclosure generally relates to protective devices and, particularly, to a protective device for a portable electronic device.

2. Description of Related Art

Protective cases are usually tight fitting and so it can be difficult to pack a portable electric device in the cases. Additionally, when the battery of a portable electronic device needs to be replaced, the portable electronic device must be entirely removed from the case. This kind of protective case is inconvenient.

Therefore, there is room for improvement within the art.

BRIEF DESCRIPTION OF THE DRAWINGS

Many aspects of the protective device for portable electronic device can be better understood with reference to the following drawings. The components in the drawings are not necessarily drawn to scale, the emphasis instead being placed upon clearly illustrating the principles of the battery cover assembly. Moreover, in the drawings, like reference numerals designate corresponding parts throughout the several views, in which.

DETAILED DESCRIPTION

Figure 1:
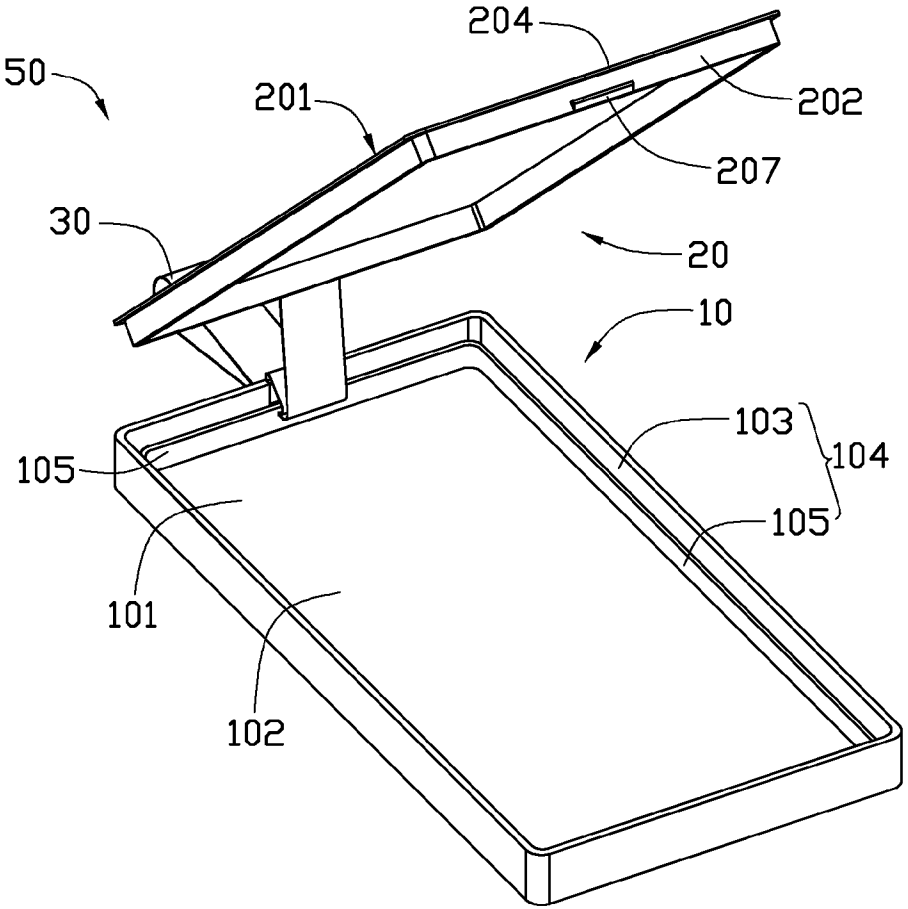
FIG. 1 is an isometric view of a protective device for portable electronic device showing an open state.
Figure 2:
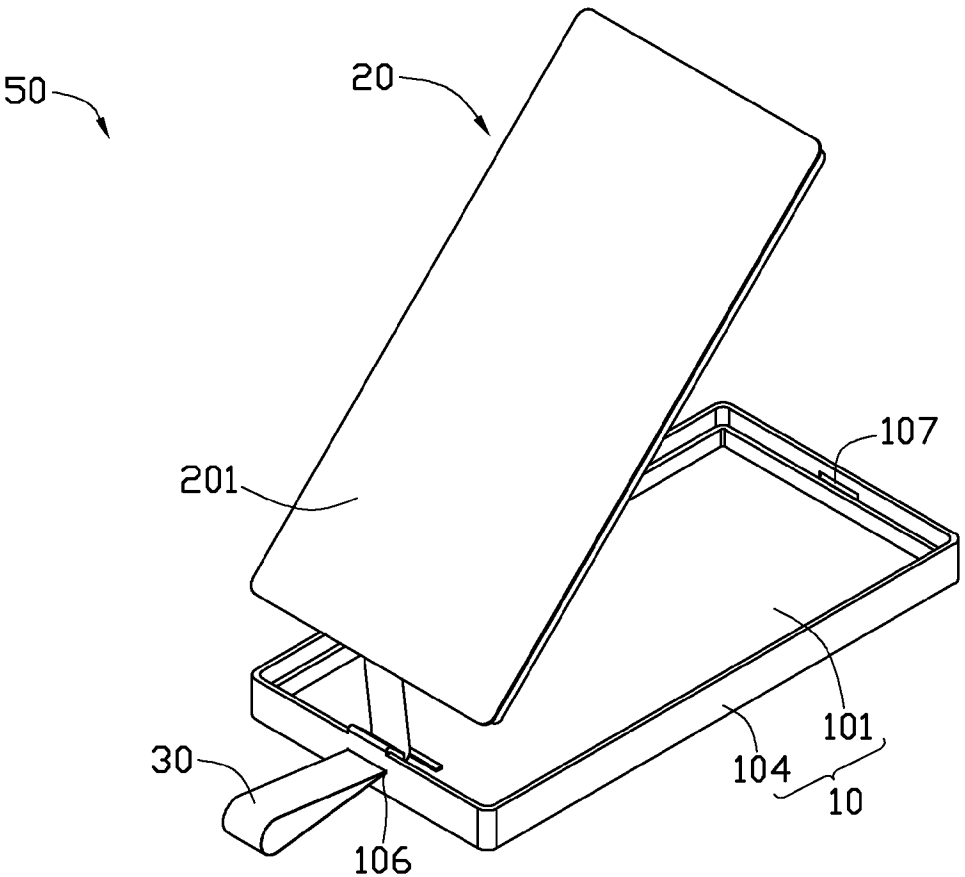
FIG. 2 is similar to FIG. 1, but viewed from another aspect.

FIGS. 1 and 2 show a protective device 50 for a portable electronic device. The portable electronic device can be a mobile phone, an Mp3 player, or any similar portable communication device. The protective device 50 includes a first housing 10, a second housing 20, and a connecting strap 30.

The first housing 10 includes a recess portion 101, and a stepped sidewall 104 with a lower thick portion 105 and an upper thin portion 103. The stepped portion acts as ledge for the second housing 20 to rest against when the protective device 50 is closed. The recess portion 101 and the stepped sidewall 104 are cooperatively define a receiving cavity 102 having a shape corresponding to the portable electronic device. Opposite ends of the stepped sidewall 104 define a cutout 106 and a groove 107 respectively.

The second housing 20 includes a cover portion 201 and a frame portion 202. The frame portion 202 is shaped to snuggly fit inside the first housing 10 and abut against the ledge. The frame portion 202 perpendicularly extends from the cover portion 201. A flange 204 is formed on the cover portion 201. The frame portion 202 forms a latching portion 207 engageable in the groove 107.

Figure 3:
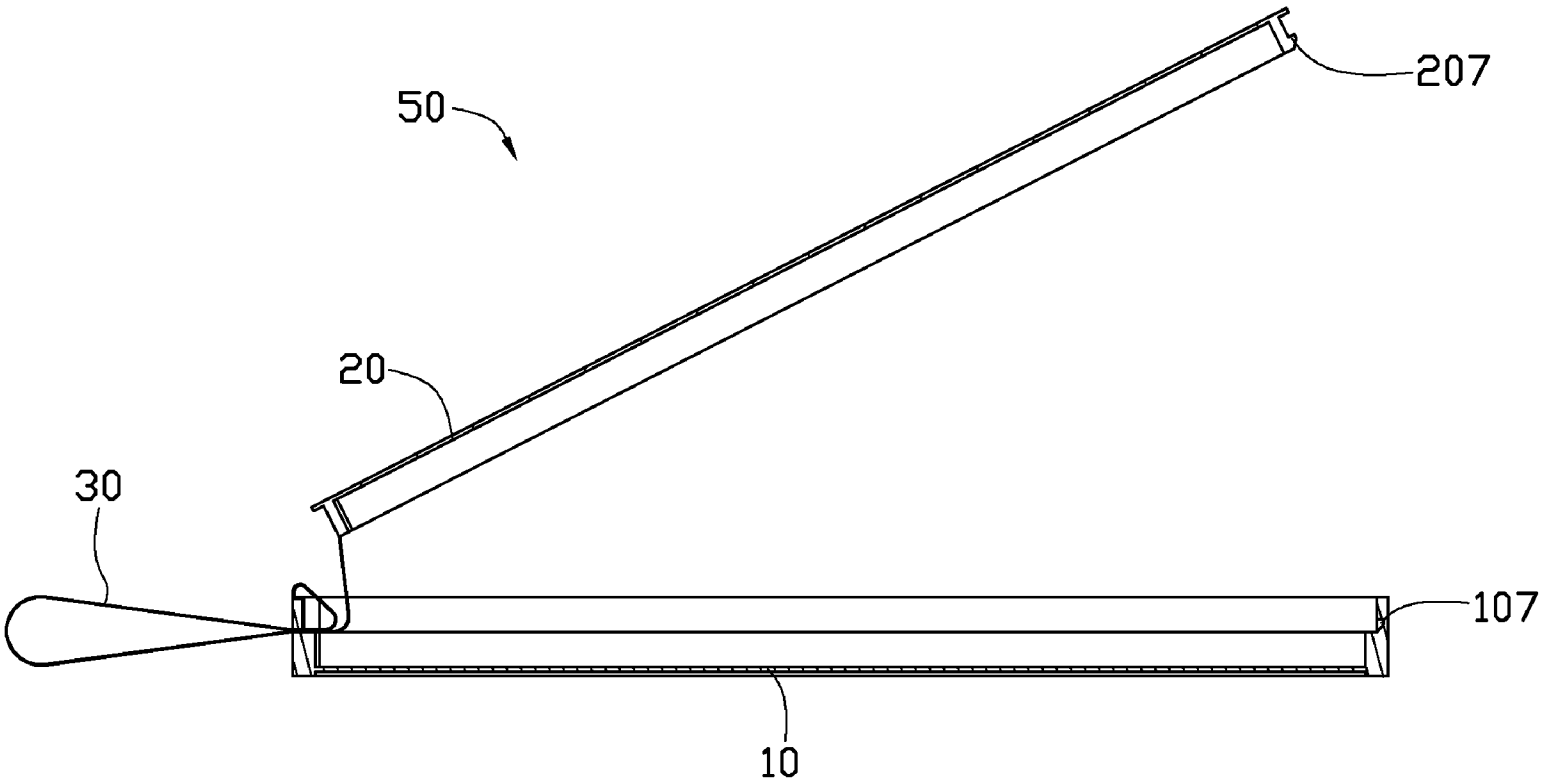
FIG. 3 is a cross-section of the protective device of FIG. 2.

Preferably, the first housing 10 and the second housing 20 are made of soft transparent rubber-like material. The connecting strap 30 can be made of a material that is softer than the material used in the first housing 10 and the second housing 20. Exemplary soft materials include leather (natural and artificial), all types of fabrics, woven clothes, textiles, and nylon. The first housing 10, the second housing 20 and the connecting strap 30 may be integrally formed by injection molding. Referring to FIG. 3, one end of the connecting strap 30 is attached to the first housing 10, the other end of the connecting strap 30 is attached to the second housing 20. In this exemplary embodiment, one end of the connecting strap 30 is fixed to the stepped wall 104. Then, a portion of the connecting strap 30 is looped and threaded through the cutout 106 to be located outside protective device 50. Then, the connecting strap 30 is looped again and threaded through the cutout 106 into the protective device 50 with the other end of the connecting strap 30 fixed to the second housing 20. When the looped end of the connecting strap 30 is pulled outward, the first housing 10 and the second housing 20 are pulled closer together to be attached to each other. When the first housing 10 and the second housing 20 are pulled apart to open the protective device 50, the looped end of the connecting strap 30 is pulled inward.

Figure 4:
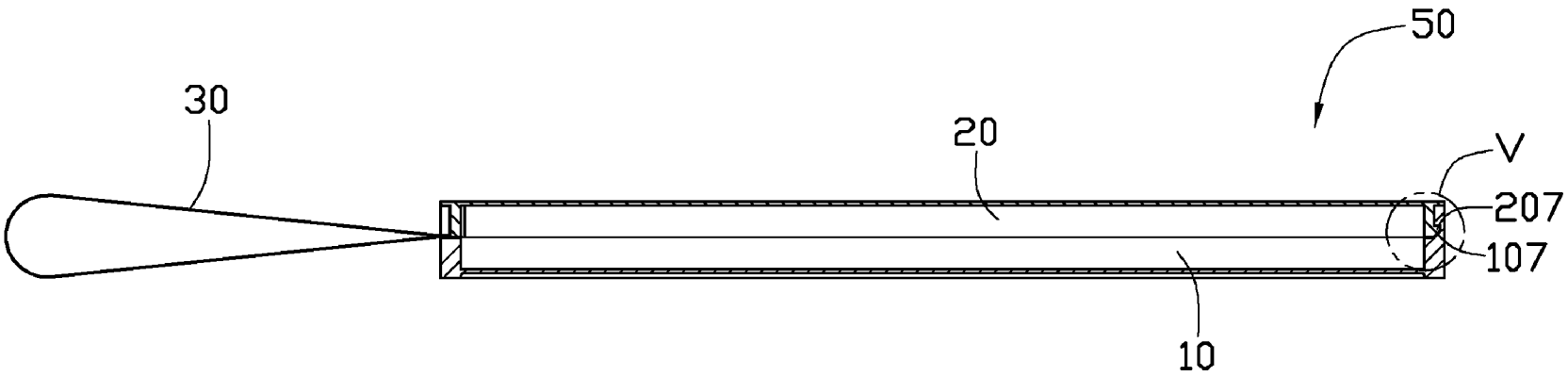
FIG. 4 is a cross-section of the protective device showing a closed state.
Figure 5:
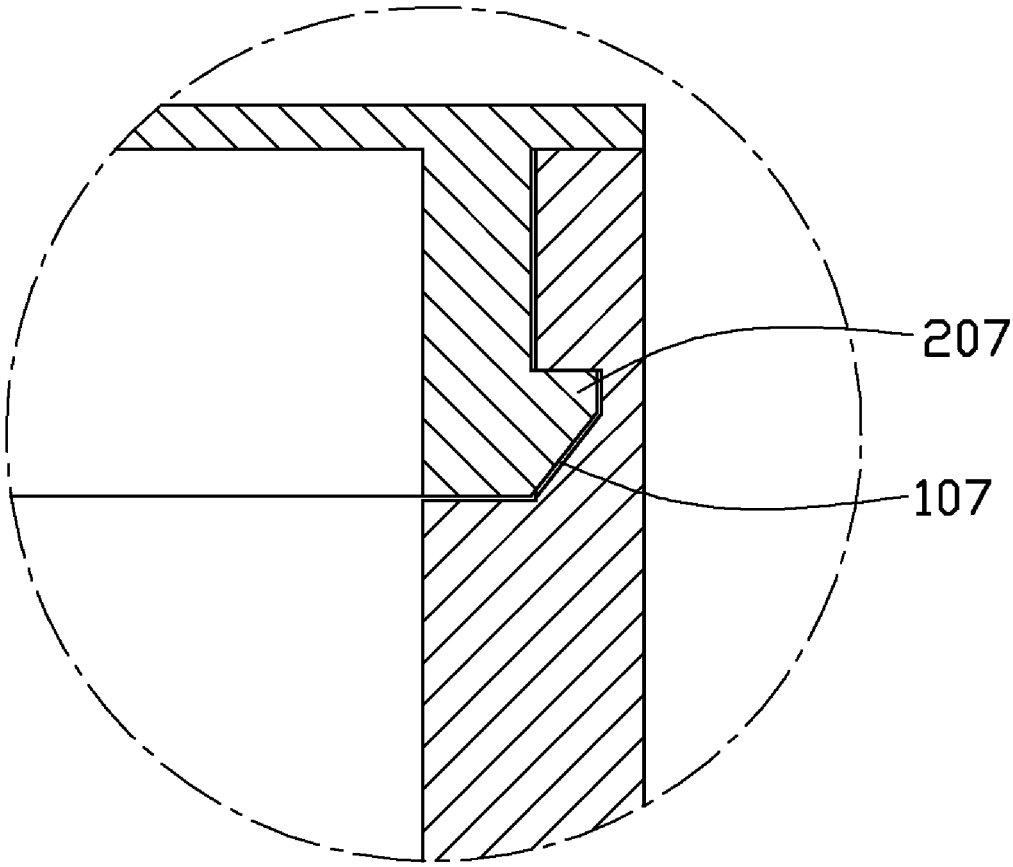
FIG. 5 is an enlarged view of circled portion V in FIG. 4.

Referring to FIGS. 4 and 5, in use, first, a portable electronic device (not shown) is placed into the receiving cavity 102 of the first housing 10. Then, the connecting strap 30 is pulled until the flange 204 of the second housing 20 is adjacent to the first housing 10. Then, the second housing 20 is pressed downward to force the frame portion 202 to abut the ledge. The latching portion 207 is latched into the groove 107. The flange 204 abuts the stepped wall 104. Thus, the protective cover 50 completely covers the portable electronic device. When the portable electronic device is to be removed from the protective cover 50, the user bends the flange 204 to make the latching portion 207 separate from the groove 107. Then, as the second housing 20 is moved away from the first housing 10, the connecting strap 30 is pulled inwardly. The user may conveniently access the device without having to remove the portable electronic device from protective case 50.

The connecting strap 30 may be easily pulled inward or outward to make the second housing 20 be attached or separated to the first housing 10 for conveniently replacing the battery. Thus, the protective device 50 is easy to operate. Furthermore, the second housing 20 may not easily be lost since the connecting strap 30 is always connected to the first housing 10. In addition, the connecting strap 30 may be made long enough for use as a strap that can be dangled from a user's wrist or neck.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A protective device for portable electronic device comprising:

a first housing defining a cutout;

a second housing; and a connecting strap, the connecting strap having a first end, a second end, and a flexible strap portion between the first and second ends;

wherein the second housing together to be connected to each other or pulled inwardly as the the first end of the connecting strap is directly fixed to the first housing, a portion of the flexible strap portion adjacent the first end is looped and threaded outward through the cutout, the flexible strap portion is reversely looped and threaded inward through the same cutout and forms a variable length looped portion, the second end of the connecting strap is also directly fixed to the second housing.

2. The protective device for portable electronic device as claimed in claim 1, wherein the first housing includes a recess portion and a stepped sidewall, the recess portion and the stepped sidewall cooperatively define a receiving cavity having a shape corresponding to the portable electronic device.

3. The protective device for portable electronic device as claimed in claim 2, wherein the stepped sidewall defines the cutout, and the connecting strap is threaded through the cutout twice.

4. The protective device for portable electronic device as claimed in claim 2, wherein the stepped sidewall of the first housing defines a groove, and the second housing forms a latching portion receivable in the groove.

5. The protective device for portable electronic device as claimed in claim 2, wherein the stepped sidewall includes with a lower thick portion and an upper thin portion, a stepped portion therebetween act as ledge to rest against the first housing.

6. The protective device for portable electronic device as claimed in claim 4, wherein the second housing includes a cover portion and a frame portion connected to the cover portion, a flange is formed on the cover portion.

7. A protective device for portable electronic device comprising:

a first housing including a recess portion and a stepped sidewall, the stepped wall defining a cutout;

a second housing including a cover portion and a frame portion, the frame portion joining to the stepped sidewall; and a connecting strap, the connecting strap having a first end, a second end, and a flexible strap portion between the first and second ends; the first end of the connecting strap directly fixed to the first housing, a portion of the flexible strap portion adjacent the first end being looped and threaded outward through the cutout, the flexible strap portion being reversely looped and threaded inward through the same cutout and forming a variable length looped portion, the second end of the connecting strap being also directly fixed to the second housing.

8. The protective device for portable electronic device as claimed in claim 7, wherein the recess portion and the stepped sidewall cooperatively define a receiving cavity having a shape corresponding to the portable electronic device.

9. The protective device for portable electronic device as claimed in claim 8, wherein the connecting strap is threaded through the cutout twice.

10. The protective device for portable electronic device as claimed in claim 8, wherein the stepped sidewall of the first housing defines a groove, the second housing forms a latching portion received in the groove.

11. The protective device for portable electronic device as claimed in claim 8, wherein the stepped sidewall includes with a lower thick portion and an upper thin portion, a stepped portion therebetween acts as ledge to rest against the first housing.

12. The protective device for portable electronic device as claimed in claim 8, wherein the second housing includes a cover portion and a frame portion connected to the cover portion, and a flange is formed on the cover portion.

* * * * *